US006199620B1

(12) United States Patent
Benedetti et al.

(10) Patent No.: US 6,199,620 B1
(45) Date of Patent: Mar. 13, 2001

(54) METHOD TO TRANSFORM A ROLLING PLANT

(75) Inventors: Gianpietro Benedetti, Campoformido; Giovanni Coassin, Pordenone, both of (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 09/088,879

(22) Filed: Jun. 2, 1998

(30) Foreign Application Priority Data

Sep. 15, 1997 (IT) ..... UD97A0157

(51) Int. Cl.[7] ..... B22D 11/12
(52) U.S. Cl. ..... 164/476; 164/418
(58) Field of Search ..... 164/476, 418

(56) References Cited

U.S. PATENT DOCUMENTS 5,601,137 * 2/1997 Abe et al. ..... 164/418

FOREIGN PATENT DOCUMENTS

| | | | |
|---|---|---|---|
| 3520403 | | 1/1987 | (DE) . |
| 648552 | | 4/1995 | (EP) . |
| 665296 | | 8/1995 | (EP) . |
| 724920 | | 8/1996 | (EP) . |
| 61-56705 | * | 3/1986 | (JP) . |

OTHER PUBLICATIONS

Patent Abstracts of Japan vol. 010, No. 218 (M–503) Jul. 30, 1986 & JP 61 056705A (Ishikawajima Hara Heavy Ind. Co., Ltd) Mar. 22, 1986.

Baier J. C. et al, Modernization of Bethlehem's Sparrows Point 68–in. Hot Strip Mill Iron and Steel Engineer, vol. 70, No. 3, Mar. 1, 1993, pp. 25–31.

Mott R. et al, Die Leistungen Der CSP–Anlage Im Werk Hickman von Nucor Steel Und Ihr Weiterer Ausbau, Stahl Und Eisen, vol. 114, No. 6, Jun. 13, 1994, pp. 125–132, 298.

Patent Abstracts of Japan vol. 006 No. 216 (M–168) Oct. 29, 1982 & JP 57 121809 (Shin Nippon Seitetsu KK) Jul. 29, 1982.

* cited by examiner

*Primary Examiner*—Harold Pyon
*Assistant Examiner*—I.- H. Lin
(74) *Attorney, Agent, or Firm*—Antonelli, Terry, Stout & Kraus, LLP

(57) ABSTRACT

Method to transform a rolling mill in order to revamp an old-type rolling line (10) fed by slabs with a thickness greater than 160 mm and arriving from an accumulation store (12) and to insert a segment of new line comprising at least a continuous casting machine (19) to produce thin and medium slabs, with attached relative operating assemblies such as extraction, straightening, shearing devices etc., the old line (10) comprising a roughing unit with one or more stands and a terminal segment (21) with a finishing train (15), a cooling area (17), systems to collect the product (18*a*, 18*b*) etc., the segment of new line (110) being achieved and installed in a position near the old line (10) while the old line (10) continues working, the segment of new line (110) being equipped substantially at the terminal end with a movable element (120) in order to be at least temporarily connected to the terminal end (21) of the old line (10).

13 Claims, 3 Drawing Sheets

METHOD TO TRANSFORM A ROLLING PLANT

FIELD OF APPLICATION

This invention concerns a method to transform a rolling plant.

The invention is applied to revamp rolling lines employed in plants of the old type, principally operating semi-continuously, where slabs pre-sheared to size are fed from store areas in hot or cold loading, with lines adopting more modern technologies which produce thin slabs from a continuous casting machine located directly in line with the rolling train.

STATE OF THE ART

In recent years the technologies used in continuous casting and rolling have been the subject of intense and exhaustive studies and experimentation in order to find ever more advanced technological solutions which can combine great productivity, cost-effectiveness and a high inner and surface quality of the product.

These studies and experiments have brought about particular technological developments, specifically in the field of medium and thin slabs continuously cast from an ingot mold, so that it has become possible to hypothesise and achieve a continuous casting line where the rolling train is directly connected to the ingot mold.

This transformation of the plants has been motivated by the need to improve the quality of the product, to reduce production costs, to increase production, and to extend the range of products, particularly with regard to thinner thickness.

This solution has however entailed the problem that a great number of old plants, which employ rolling lines arranged to roll slabs starting from a thickness of around 160–350 mm and fed from store areas, need to be transformed into more advanced plants which adopt the new technologies.

The necessary transformation, which involves or will involve within a short time substantially a large majority of the old-type rolling plants, necessarily causes a long downtime in the plant, of about 5–6 months, in order to carry out the necessary work, including foundation work, to replace and install the new assemblies; in actual fact, this causes a considerable economic loss for the steel works which can only be recouped when the new plant has been active for a long period.

The present Applicant has designed and tested this invention to solve this serious operating problem with a solution which is relatively simple and such as will make it substantially painless to revamp an old plant so as to install more advanced technology, and also to obtain further advantages as will be shown hereinafter.

DISCLOSURE OF THE INVENTION

The purpose of the invention is to adopt a procedure which can be adopted in the transformation of an old-type semi-continuous plant, where rolling is carried out starting from slabs of 160–350 mm thick arriving from a store area, into a plant with a continuous casting machine for thin slabs arranged directly in line with the rolling train which will minimise the economic impact caused by the transformation.

According to the invention, the new segment of line, comprising the continuous casting machine for thin slabs and the operating assemblies placed downstream thereof, for example the heating and temperature equalisation furnace, is achieved in a position adjacent to (or at least near, depending on the configuration of the plant) the already existing line which continues to work.

The operating assemblies associated with the continuous casting machine may comprise an extraction assembly, a straightening assembly, a shearing assembly, possibly heating assemblies, possibly descaling assemblies, and possibly other assemblies functional to the working and processing of thin slabs.

The new segment of line according to the invention comprises at the end at least a movable connection element suitable to connect the new segment of line with the terminal end of the pre-existing line, which remains unchanged; the terminal segment comprises a possible descaling assembly, the finishing train, the cooling area, the assemblies to coil and discharge the product, conditioning, measuring, shearing and emergency assemblies, etc.

According to a variant, the terminal segment comprises one or more roughing stands at the leading end.

According to a further variant, the terminal segment comprises a reversible-type roughing stand, possibly associated with a coil box, at the leading end.

According to one embodiment, the connection element can be translated in a direction parallel to itself.

According to a variant, the connection element is movable in a pivoting manner.

According to another variant, the connection element is moved on rails.

According to yet another variant, the connection element is moved on a trolley or slider or translatable platform.

When the new segment of line has been prepared, the conversion of the plant is carried out by connecting the new segment to the terminal segment which remains unchanged; according to the preferential embodiment, this occurs when the plant is given a periodical and pre-determined maintenance operation.

During this pre-determined downtime, all the necessary connections can be made: the hydraulic and electrical connections, and all the other equipping and installation operations necessary to reconfigure the line.

In this way, the downtimes when the plant is totally stopped are substantially eliminated and the economic impact caused by the transformation of the plant is minimised.

According to another evolution of the invention, once the new line has been installed and has started working, the old line arranged on an axis with the rolling train is completely dismantled and replaced by a new line with a continuous casting machine.

This operation can be carried out without interfering in any way with the already completed first line, which can operate under normal working conditions, and therefore without compromising the productivity of the newly transformed plant in any way.

ILLUSTRATION OF THE DRAWINGS

The attached Figures are given as a non-restrictive example and show some preferential embodiments of the invention as follows:

FIG. 1 shows a first embodiment of the invention;

FIGS. 2 and 3 show variants of FIG. 1.

FIG. 4 shows another variant of FIG. 1.

The slabs supplied from the store 12 can arrive hot or cold, they are pre-sheared and normally have a thickness of between 160 and 350 mm.

The slabs are progressively sent to a plurality of roughing stands arranged in sequence, in this case 14*a,* 14*b,* 14*c,* 14*d* and 14*e,* and are then sent to the finishing train 15 comprising in this case six finishing stands 16.

Figure 4:
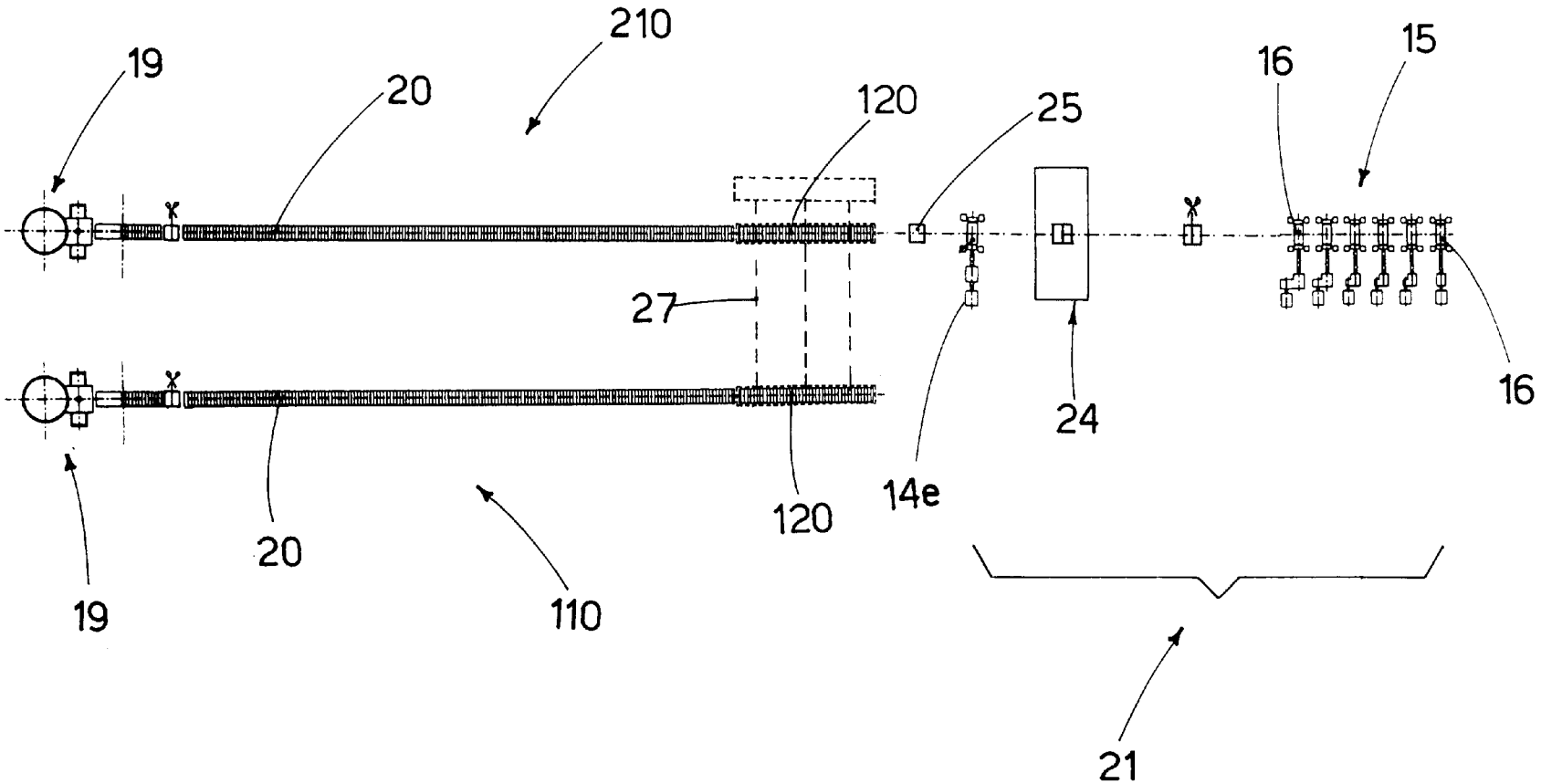

It is the same, as in FIG. 4, if the line 10 includes only one roughing stand, for example 14*e,* of the reversible type, followed by a coil box 24 and preceded by a descaling assembly.

For simplicity of illustration, obviously, no further description is given of the plurality of operating and functional assemblies—conditioning, measuring, auxiliary, emergency assemblies, etc.—which any person of skill in the art can identify as essential or at least important within the line 10.

After the finishing train 15 there is the cooling area 17, for example a cooling bed or plane, which is followed in turn by the systems to collect the product, in this case comprising two downcoilers 18*a* and 18*b*.

Such a line 10 as described is well-known to the state of the art.

In this case, adjacent to this old-type line 10, or at least nearby, a segment of new line 110 is progressively achieved which adopts the most advanced and recent technology of continuous casting for slabs and comprising at least a continuous casting machine 19.

In this case, the segment of new line 110 is parallel to the old line 10, but it is also possible for the new line 110 to be oblique thereto.

According to a variant which is not shown here, there may be two or even more segments of new line 110 which can be connected, either temporarily or stably, to the old line 10.

The slabs produced by the continuous casting machine 19 are advantageously around 50–70 mm thick, but according to the invention they may also have other formats according to the possibilities offered by the continuous casting machine 19, the products which are to be obtained, the configuration of the finishing train 17, the inclusion of one or more roughing stands 14, etc.

Only the components of the segment of new line 110 which are strictly essential have been shown here: any person of skill in the art can complete the line with the operating assemblies which are functionally suitable according to the requirements of the specific plant.

The sizing of the new segment 110, both in terms of length and configuration, can be a function of the specific requirements of the plant and the products which are to be obtained.

Downstream of the continuous casting machine 19, the new segment 110 comprises a rollerway 20 to feed the slabs whose terminal segment 120 is movable and has the function of connecting the rollerway 20 to the terminal segment, indicated in its entirety by the reference number 21, of the old line 10.

The terminal segment 120, in a first embodiment, can be structured as a tunnel furnace.

In another embodiment, the terminal segment 120 is structured as a tunnel furnace with burners.

In yet another embodiment, the terminal segment 120 has heating and temperature equalisation means for the sections of slab contained inside.

Figure 1:
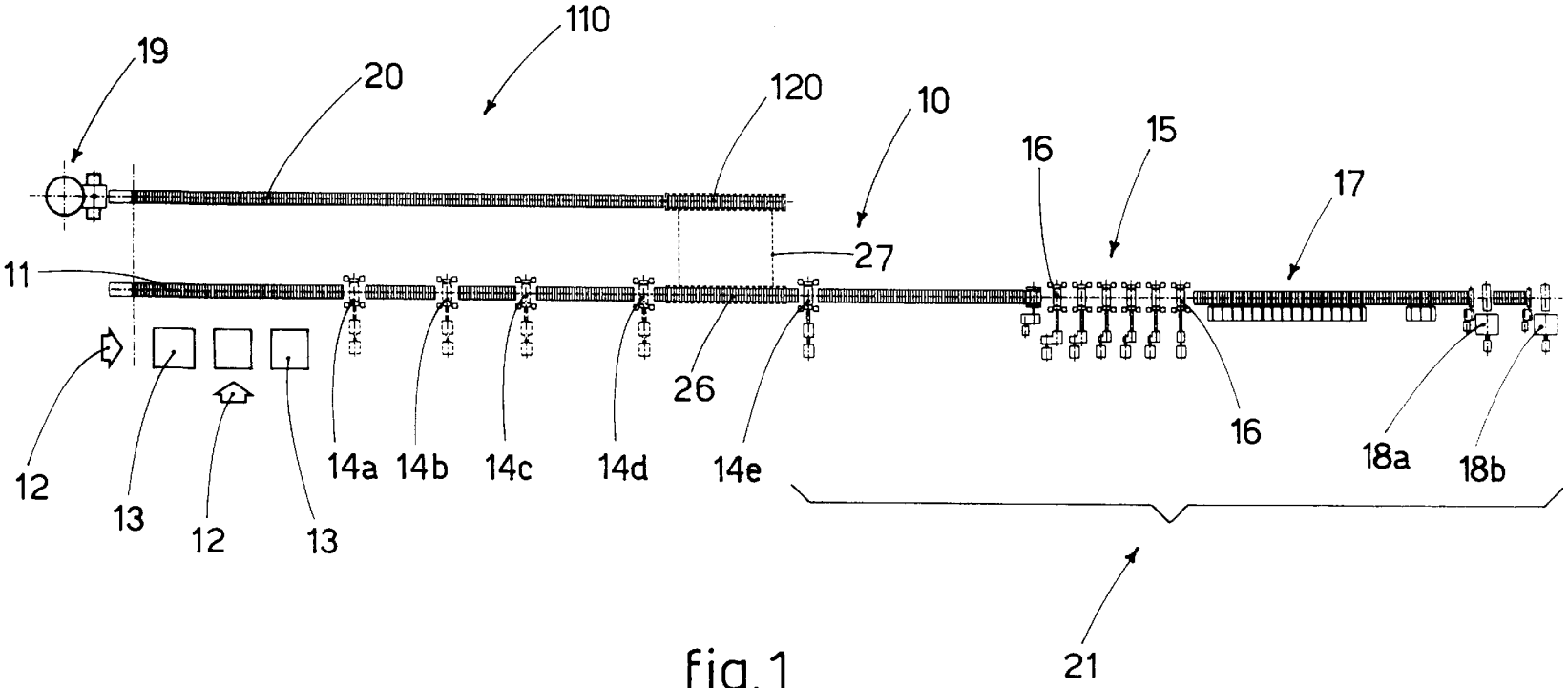
In FIG. 1, the reference number 10 denotes generally an old-type rolling line, comprising an initial segment with a rollerway 11 feeding the slabs fed from a store 12 through heating and temperature equalisation furnaces 13.

According to the embodiment shown in FIG. 1, the terminal end 120 can be moved in a direction parallel to itself so as to be inserted into the old line 10, either on rails 27 or a motorised trolley.

In this embodiment, according to a variant, the rollers of the terminal segment 120 are interpenetrating with the rollers of the corresponding element 26 of the old line 10 so that modifications to the element 26, in order to achieve the transfer of the slabs from the old line 10 to the new line 110, can be limited to a minimum.

According to a variant, there is a translating platform on which the element 120 of the new line 110 and the element 26 of the old line 10 are mounted.

In FIG. 4, if no descaling assembly is already included, then a descaling assembly 25 is installed immediately upstream of the reversible roughing stand 14*e*.

Figure 2:
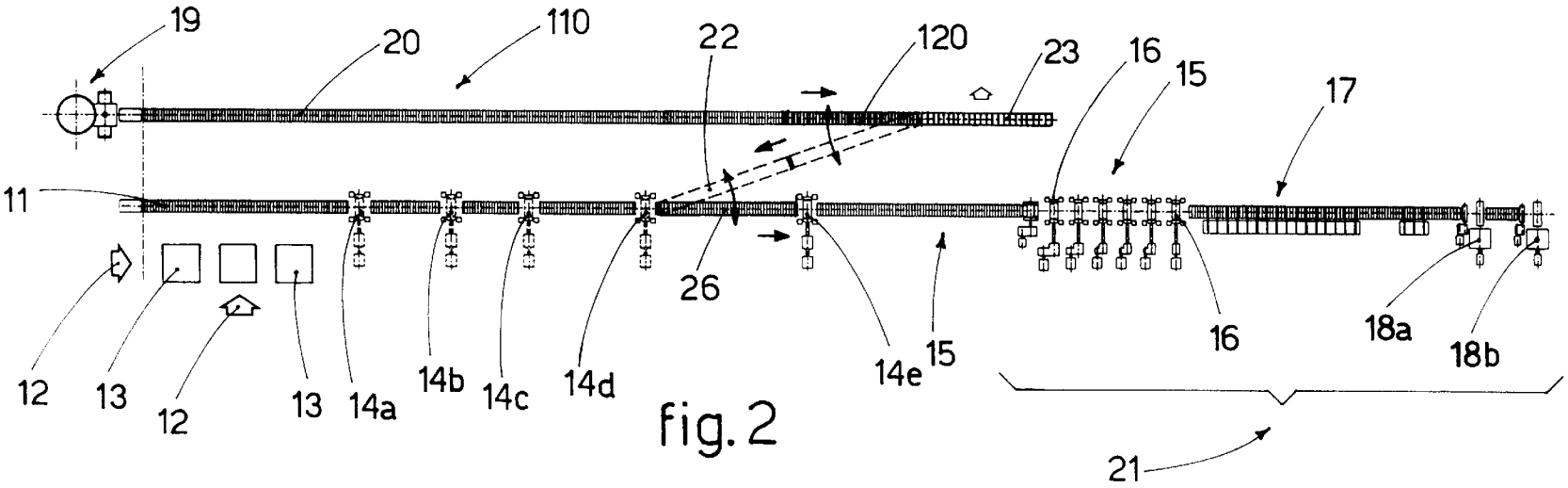
Figure 3:
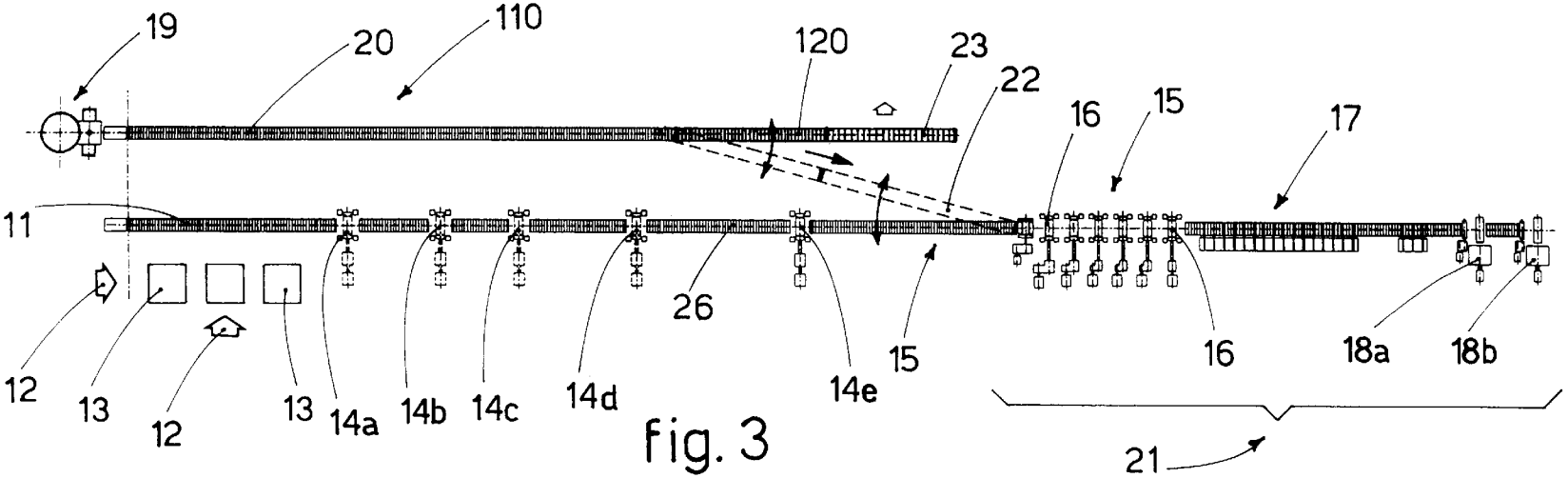

According to a variant shown in FIGS. 2 and 3, there is at least a terminal segment 120 movable in a pivoting manner around its rear end (FIG. 2) or its front end (FIG. 3), cooperating with a connection element 22, which is also movable in a pivoting manner, of the old line 10 so as to align with the segment 120 and transfer the slabs.

In this case, the terminal segment referenced by 21, which remains unchanged even after the plant has been transformed with the new segment of line 110, has a roughing stand 14*e* which acts on the thin slabs produced by the continuous casting machine 19 even after conversion has been completed.

In the case of FIG. 2, in the new line 110 the slabs pass into the roughing stand 14*e*.

In FIG. 3, on the contrary, the slabs produced by the new line 110 do not pass through the roughing stand 14*e,* inasmuch as they emerge from the continuous casting machine with a shape which allows them to be sent directly to the finishing train 15.

According to another variant, the terminal segment 120 can oscillate in a pivoting manner around its forward or rear end according to whether the roughing stand 14*e* needs to be included or not.

In the variant shown in FIGS. 2 and 3, there is a rollerway 23 to discharge the discarded slabs downstream of the movable terminal segment 120.

According to a variant, there are two or more roughing stands which remain in the line after conversion.

According to a further variant, the roughing stand 14*e* is of the reversible type.

According to the invention, the necessary connections, for example hydraulic and electrical, to make the new segment of line 110 operational—since these connections derive from the old line—are carried out during a pre-determined maintenance of the old line 10, so as to make the conversion economically painless.

Once the new segment of line 110 has been connected to the terminal segment 21, which remains unchanged, the segment of old line 10 which has been replaced can be either maintained so as to work in alternation with the new line 110, or dismantled and/or reconverted.

For example, as shown in FIG. 4, a second continuous casting machine 19 and a relative second new line 210 can be inserted, with the relative assemblies, while the continuous casting plant consisting of the new line 110 is working normally, so that productivity is not prejudiced in any way, thus achieving, in the end, two continuous casting lines 110 and 210, with a shared finishing train 15, with transformation times reduced to a minimum.

What is claimed is:

1. Method to transform a rolling mill in order to revamp an old rolling line (10) fed by slabs with a thickness greater than 160 mm and arriving from an accumulation store and to insert a segment of new line (110) comprising at least a continuous casting machine to produce thin and medium slabs, with attached relative operating assemblies, the old line comprising a roughing train with one or more stands and a terminal segment with a finishing train, a cooling area, and systems to collect the product, the method comprising installing a segment of new line in a position next to the old line while the old line continues working, providing the segment of new line being equipped substantially at a terminal end with a connection terminal segment movable in a pivoting manner, and providing at least temporarily connecting the connection terminal segment of the new line to the terminal segment of the old line.

2. Method to transform a rolling mill in order to revamp an old rolling line (10) fed by slabs with a thickness greater than 160 mm and arriving from an accumulation store and to insert a segment of new line (110) comprising at least a continuous casting machine to produce thin and medium slabs, with attached relative operating assemblies, the old line comprising a rouging train with one or more stands and a terminal segment with a finishing train, a cooling area, and systems to collect the product, the method comprising installing a segment of new line in a position next to the old line while the old line continues working, providing the segment of new line being equipped substantially at a terminal end with a connection terminal segment movable transversely between two parallel positions, and providing at least temporarily connecting the connection terminal segment of the new line to the terminal segment of the old line.

3. Method as in claim 2, in which the new segment of line is installed parallel and adjacent to the old line.

4. Method as in claim 1 or 2, in which the new segment of line is installed obliquely to the old line.

5. Method as in claim 1 or 2, in which the connection terminal segment is connected upstream of at least a roughing stand.

6. Method as in claim 5, in which the roughing stand is of the reversible type and cooperates with a coil box.

7. Method as in claim 1 or 2, in which downstream of the movable connection terminal segment there is an element to discharge discarded slabs.

8. Method as in claim 1 or 2, in which, after the new line has started normal functioning, the old line is replaced by a second new line of continuous casting.

9. Method as in claim 1 or 2, in which the step of connecting the connection terminal segment to the existing terminal segment of the old line is performed during a pre-determined maintenance procedure of the old line.

10. Method as in claim 1, in which the connection terminal segment of the new line cooperate with a mating element of the old line, also movable in a pivoting manner.

11. Method as in claim 2, in which rollers of the connection terminal segment are made interpenetrating with rollers of the corresponding element of the old line.

12. Method as in claim 2, in which the connection terminal segment moves on rails.

13. Method as in claim 2, in which the connection terminal segment moves on a trolley or slider or motorised platform.

* * * * *